US009359983B2

(12) United States Patent
Canepa-Anson et al.

(10) Patent No.: US 9,359,983 B2
(45) Date of Patent: Jun. 7, 2016

(54) ACTUATOR ARRANGEMENT FOR AN ELECTROMAGNETICALLY OPERATED FUEL INJECTOR AND METHOD FOR CONSTRUCTING

(75) Inventors: Thomas W. Canepa-Anson, Richmond (GB); Bashir Khan, Cheltenham (GB); Anthony Thomas Harcombe, Richmond (GB); Mark S. Harper, Stourbridge (GB); Mark S. Graham, Bristol (GB); Stephen K. Bowers, Middlesex (GB)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 1282 days.

(21) Appl. No.: 13/257,026

(22) PCT Filed: Mar. 18, 2010

(86) PCT No.: PCT/EP2010/053573

§ 371 (c)(1),
(2), (4) Date: Jan. 12, 2012

(87) PCT Pub. No.: WO2010/106150

PCT Pub. Date: Sep. 23, 2010

(65) Prior Publication Data

US 2012/0154085 A1 Jun. 21, 2012

(30) Foreign Application Priority Data

Mar. 19, 2009 (GB) ..... 0904646.7

(51) Int. Cl.
*H01F 7/08* (2006.01)
*F02M 51/00* (2006.01)

(Continued)

(52) U.S. Cl.
CPC ..... *F02M 51/005* (2013.01); *F02M 63/0015* (2013.01); *F02M 47/027* (2013.01); *Y10T 29/49117* (2015.01)

(58) Field of Classification Search
CPC ..... F02M 63/0015; F02M 51/005; F02M 47/027; Y10T 29/49117
USPC ..... 335/220–229; 251/129.15
See application file for complete search history.

(56) References Cited

U.S. PATENT DOCUMENTS 5,114,077 A 5/1992 Cerny
6,027,049 A 2/2000 Stier (Continued)

FOREIGN PATENT DOCUMENTS

CN 101198817 A 6/2008
DE 197 12 591 10/1998

(Continued)

OTHER PUBLICATIONS

International Search Report dated Jul. 26, 2010.

*Primary Examiner* — Bernard Rojas
(74) *Attorney, Agent, or Firm* — Joshua M. Haines

(57) ABSTRACT

An actuator arrangement for an electromagnetically operated fuel injector includes a pole member having a first end face and defining an aperture extending from the first end face and an actuator core received within the aperture. The actuator core carries at least one contact member having a contact face that is exposed through the aperture. An encapsulating member is received within the aperture and surrounds the at least one contact member. The first end face of the pole member, the contact face and the encapsulating member are arranged to provide the actuator arrangement with a substantially planar surface for mating with an adjacent component, in use.

20 Claims, 5 Drawing Sheets

(51) Int. Cl.
*F02M 63/00* (2006.01)
*F02M 47/02* (2006.01)

(56) References Cited

U.S. PATENT DOCUMENTS 6,688,578 B1 2/2004 Nussio et al.
2006/0284129 A1 12/2006 Krishnaswamy et al.
2007/0289578 A1 * 12/2007 Ricco et al. ..... 123/472
2009/0058579 A1 * 3/2009 Greif et al. ..... 335/209

FOREIGN PATENT DOCUMENTS

EP 1 693 563 8/2006
EP 1 867 867 12/2007
JP 2005-36696 A 2/2005

* cited by examiner

ACTUATOR ARRANGEMENT FOR AN ELECTROMAGNETICALLY OPERATED FUEL INJECTOR AND METHOD FOR CONSTRUCTING

TECHNICAL FIELD

The invention relates to an actuator arrangement that is suitable for use within an electromagnetic fuel injector, particularly a fuel injector in a compression-ignition internal combustion engine, or 'diesel' engine.

BACKGROUND OF THE INVENTION

FIG. 1 shows a known electromagnetically operated fuel injector 2 that is particularly suited to use within diesel engines. The injector 2 is generally elongate in form and includes a nozzle holder body 4 at its upper end that is connected to an injection nozzle arrangement 6 at its lower end, in the orientation shown.

The injection nozzle arrangement 6 comprises three components that are housed within a cap nut 8 that is approximately U-shaped in cross section and which engages the nozzle holder body 4 by way of a screw thread at its more open end, thereby securing the injection nozzle arrangement 6 to the nozzle holder body 4.

The first component of the injection nozzle arrangement 6 is an elongated injection nozzle 10 having a tip end 12 that extends through an aperture 14 formed in the base of the cap nut 8. The injection nozzle 10 houses a spring biased injection needle 16 that is slidable within the injection nozzle 10 so as to control the delivery of fuel through a set of nozzle holes (not shown), in use.

A first distance piece 18 lies above the injection nozzle 10 (in the orientation shown in FIG. 1) and includes a through-drilling 20 that serves to convey pressurised fuel from a valve block 22 located adjacent and above the distance piece 18 to the injection nozzle 10. The distance piece 18 also includes a centrally disposed blind bore 24 which receives a back end of the injection needle 16 such that a control chamber 26 is defined between the injection needle 16 and the blind end of the bore 24.

The valve block 22 is positioned intermediate the distance piece 18 and the nozzle holder body 4 and includes a high pressure drilling 28 that conveys fuel from a high pressure inlet drilling 30 defined in the nozzle holder body 4 to the drilling 20 in the distance piece 18. The valve block 22 also includes a valve arrangement 32 comprising an elongate valve pin 34 and a disc-shaped armature 36 attached thereto.

The armature 36 is acted on by a electromagnetic actuator 38 that is received within a recess 40 defined in the underside of the nozzle holder body 4. Depending on the activation state of the actuator 38, the armature 36 is raised or lowered which causes the valve member 34 to engage or disengage alternately each of two respective valve seatings 42 and 43 to control the pressure of fuel within the control chamber 26.

An upper region 44 of the nozzle holder body 4 includes a lateral recess 46 which receives an electrical connector 48. A longitudinal bore 50 extends from the lateral recess 46 to the actuator recess 40. An electrical supply lead 52 (with at least two cores) extends through the longitudinal bore 50 from the electrical connector 48 to an upper face 53 of the actuator and connects thereto thereby supplying electrical energy to the actuator. It should be appreciated that the precise structural details of how the actuator 38 connects to the electrical supply lead 52 are not described.

The nozzle holder body 4 further includes a high pressure fuel inlet 54 which is defined by a transversely extending port approximately in the mid-region of the nozzle holder body 4. The fuel inlet 54 defines a conical seating surface which is shaped for engagement with a high pressure fuel supply connector (not shown), in use. An oblique drilling 56 extends from the inlet 54 into the nozzle holder body 4 and then angles downward via drilling 30 in a direction to connect to the high pressure drilling 28 defined in the valve block 22.

There is pressure on Fuel Injection Equipment (FIE) manufacturers to make FIE for engines which are smaller, lighter and more economical, including injectors of a smaller diameter. Therefore, there is a need to reduce the space efficiency and overall size of engine components such as the known fuel injector 2 as described above with reference to FIG. 1.

SUMMARY OF THE INVENTION

According to a first aspect of the present invention, there is provided an actuator arrangement for an electromagnetically operated fuel injector, comprising: a pole member having a first end face and defining an aperture extending from the first end face; an actuator core received within the aperture, wherein the actuator core carries at least one contact member having a contact face that is exposed through the aperture, wherein an encapsulating member is received within the aperture and surrounding the at least one contact member, and wherein the first end face of the pole member, the contact face and the encapsulating member are arranged to provide the actuator arrangement with a substantially planar surface for mating with an adjacent component, in use.

In one embodiment, the aperture is offset from the longitudinal axis of the pole member thereby providing a major wall portion and a minor wall portion. Since the wall portion has a greater thickness than the minor wall portion, there is room for an axial drilling in the major wall portion for carrying fuel. Beneficially, the axial drilling is parallel to the axis of the actuator which avoids the need to angled fuel connections when the actuator is installed within an injector.

Conveniently the actuator core may carry first and second contact members that are exposed through the aperture and the aperture may comprise a core member. The aperture of the pole member and the core member may then be advantageously shaped to permit the core member to be angularly orientated within the aperture relative to the pole member thereby providing a variable contact member location.

The benefit of this is that the core member can be rotationally orientated during production, and then fixed in position, thereby altering the position of the contact members relative to the pole member, whilst requiring no changes to any machined parts. There is therefore greater flexibility of the electrical contact position within the injector body so that the same design of actuator arrangement can be used with multiple configurations of electrical connectors. These configurations may vary dependent on the engine manufacturers' installation requirements.

In one embodiment, the aperture is circular and the core member is circular so as to permit unlimited angular variation between the two components about the longitudinal axis of the aperture. However, it should be appreciated that other complementary shapes would also provide the same advantage.

An additional feature is that the first and second contact members may be integrated within an insulator member that is carried on the core member.

In order to provide the actuator arrangement with a 'clean' geometric surface with which to engage adjacent parts, in use, an encapsulating layer may be carried on the insulator member to envelop the first and second contact members such that contact faces defined by the contact members are substantially flush with a first surface of the encapsulating layer. In addition, the first and second contact faces defined by the first and second contact members may be substantially flush with a first surface of the pole member.

Conveniently the actuator core may comprise a solenoid having first and second terminal ends and a core member, an insulator member carried on the core member, and first and second electrical contact members received within the insulating member. Advantageously the first terminal end of the solenoid may be secured to the first contact member and the second terminal end of the solenoid may be secured to the second contact member.

In order to provide a simple connection between the solenoid and the contact members, it is beneficial for the first terminal end to be wound directly around the first contact member for one or more turns and for the second terminal end to be wound directly around the second contact member for one or more turns. In this way, edges of the contact members act to grip the turns of the terminal ends of the solenoid.

Since the terminal ends of the solenoid are wound directly around the contact members which define electrical contact faces, a more secure contact arrangement is provided. Also, this arrangement is elegantly simple, quick to configure and hence cheaper to make. This is to be compared with existing methods of coupling the terminal ends of the solenoid to parts of the contact members that are remote from the contact face.

Also, since the contact member arrangement is simplified, the position of each contact member on the core member can be tailored to suit a specific installation which may have a preferred contact member position that differs from another installation. To this end, since the insulation member is a polymeric material, the contact members may be inserted into the insulating member through local melting: for example, by heating or by the use of an ultrasonic welding type technique being applied to the contact members, whereby the polymer is caused to melt locally where it touches the contact members. Thus, it is not necessary to pre-form a shaped recess in the insulating member to receive each of the contact members.

The contact members may take many different geometric forms whilst providing the advantage of the invention. For example, a regular polyhedron is a suitable shape, as is a cuboid.

Preferably the first and second contact members are received in the insulating member by initially melting the insulating member in regions local to the first and second contact members and urging the first and second contact members into the melted regions of the insulating member.

Preferably, the solenoid is wound on a coil former carried by the core member and wherein the coil former and the insulating member are linked by a linking member that extends through a slot provided on the core member, such that the insulating member and the coil former are a unitary component.

According to a second aspect of the present invention, there is provided an actuator arrangement for an electromagnetically operated fuel injector, comprising: a pole member defining an aperture; an actuator core received within the aperture, wherein the actuator core carries first and second contact members that are exposed through the aperture, wherein the aperture of the pole member, and the core member, are shaped to permit the core member to be angularly orientated within the aperture relative to the pole member thereby providing a variable contact member location.

According to a third aspect of the present invention, there is provided an actuator arrangement for an electromagnetically operated fuel injector, comprising: an actuator core including a solenoid having first and second terminal ends; an insulator member carried on the core member; and first and second electrical contact members received within the insulating member, wherein the first terminal end of the solenoid is secured to the first contact member and wherein the second terminal end of the solenoid is secured to the second contact member.

According to a fourth aspect of the present invention, there is provided a method of constructing an electromagnetic actuator for a fuel injector, comprising: providing an actuator core member, moulding an insulating member onto a first end face of the core member; providing at least one contact member, and integrating the at least one contact member with the insulating member by locally melting the insulating member in the region of the at least one contact member to soften said insulating member and urging said at least one contact member into the insulating member.

Constructing the actuator in this way provides flexibility in the positioning of the at least one contact member on the actuator during production. The exact location of the contact member(s) can therefore be tailored during the production process to suit a particular injector installation. As has been mentioned, the local heating may be obtained through direct heating or alternatively through an ultrasonic welding technique for example.

Beneficially, the method also includes moulding a coil former onto the core member and forming a solenoid onto the core member. The coil former is thus moulded onto the core member in situ such that the core member provides structural support for the coil former and the solenoid winding process. Moulding the coil former in situ enables it to be provided with a thinner wall which provides more space for the solenoid winding.

In one embodiment, the insulating member and coil former are a unitary moulded component, and they are formed by the same moulding process, preferably injection moulding.

In a fifth aspect, the invention provides a method for constructing an electromagnetic actuator for a fuel injector, comprising providing a pole member having first and second faces and defining an aperture, and machining the first and second pole faces of the pole member substantially simultaneously.

Machining both the upper and lower faces of the pole member faces at the same time considerably shortens the processing time which has a corresponding effect on the reducing the cost of producing the actuator. A further benefit is to improve the degree of geometrical match between the surfaces which is assists with mating the faces with other components within a fuel injector, for example.

The method may further include the step of receiving an actuator core member within the aperture, the core member having first and second electrical contact members associated therewith which are exposed through the aperture and substantially coplanar with the first end face of the outer pole member, and wherein an end face of the core member is exposed through the aperture so that it is substantially coplanar with the second end face of the outer pole member. The step of machining the first and second faces of the pole member also includes machining the contact members and the first end face of the core member substantially simultaneously. Therefore, in addition to the first and second faces of the pole member being machined at the same time, so too are the faces of the contact members and the core member, thus achieving a further reduction in processing times compared with machining each face individually.

The invention also resides, in a sixth aspect, in a method for constructing an electromagnetic actuator for a fuel injector, comprising providing a pole member having first and second faces and defining an aperture, receiving an actuator core member within the aperture, the core member having at least one contact member associated therewith exposed through the aperture and substantially coplanar with the first end face of the outer pole member, and machining the first end face of the pole member and the at least one contact member substantially simultaneously.

Machining the upper face of the pole member and the electrical contacts substantially simultaneously improves the geometrical match between the surfaces which is a benefit for mating the faces with other adjacent components within a fuel injector.

In one embodiment, the machining process is grinding which provides a highly accurate and smooth finish. However, other machining processes are also applicable such as lapping, milling and abrasive honing.

It will be appreciated that preferred and/or optional features of the first aspect of the invention may be provided in the second to sixth aspects of the invention also, either alone or in appropriate combinations.

BRIEF DESCRIPTION OF THE DRAWINGS

Reference has already been made to FIG. 1 which is a schematic view of a known electromagnetic fuel injector. In order for the invention to be more readily understood, it will now be described with reference to the following drawings, in which.

DETAILED DESCRIPTION OF THE EMBODIMENTS

Figure 1:
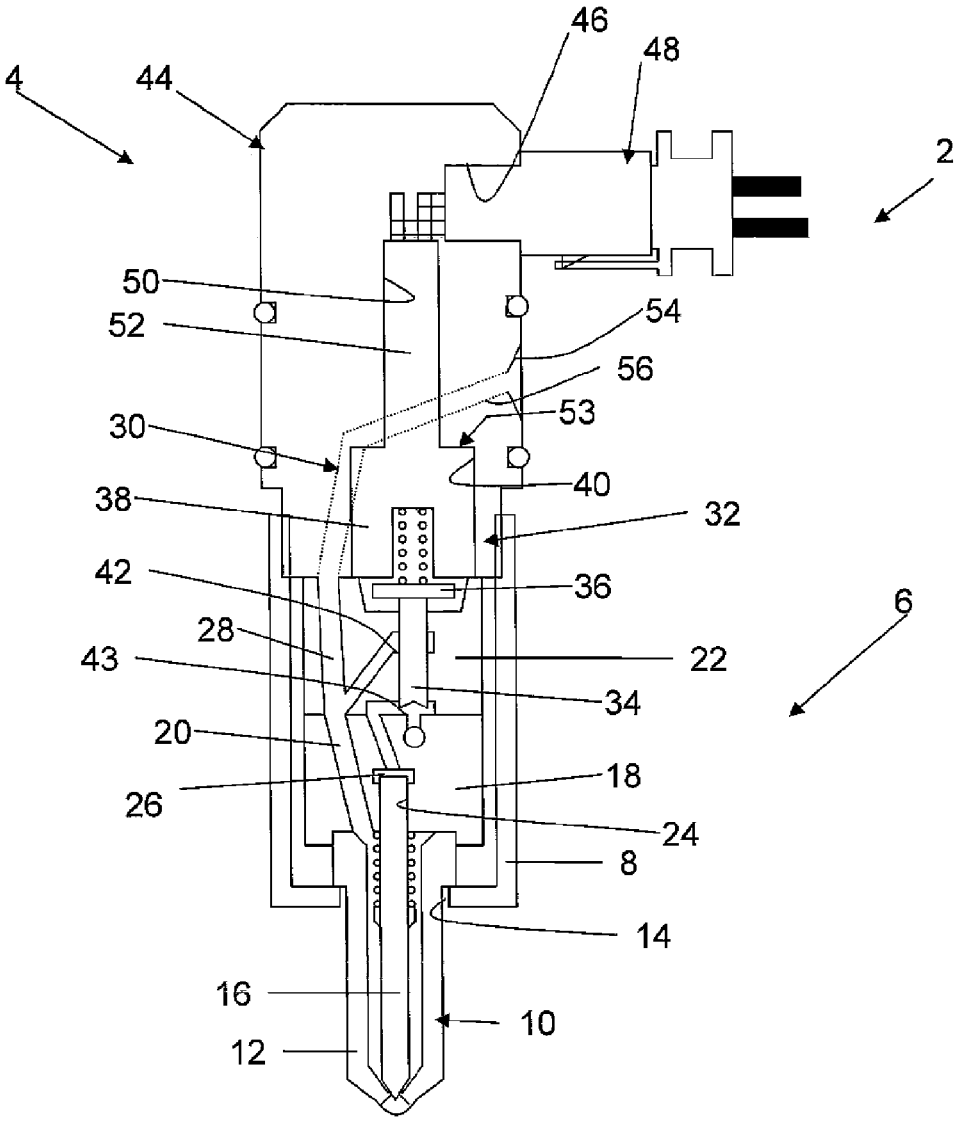
Figure 1 Prior Art

Referring to the various views in FIGS. 2 to 5, an actuator arrangement 60 is shown that is suitable for use within the electromagnetically operated fuel injector 2 of FIG. 1.

The actuator arrangement 60 includes two principal components: a generally cylindrical outer pole member 62 or "pole piece" which houses an actuator core 64.

The pole piece 62 includes upper and lower faces 61, 63 and a large circular aperture 66 which is offset from the central longitudinal axis of the pole piece 62 and which receives the actuator core 64. Since the aperture 66 is offset from the longitudinal axis, the pole piece 62 is provided with a wall of varying thickness. As is shown clearly in FIG. 4, the pole piece 62 is provided with a minor wall region 68 which is relatively thin compare to a major (relatively thick) wall region 70.

The aperture 66 is of uniform diameter along a substantial part of its length although it includes a tapered section towards its lower end so that the aperture at the lower end face 63 of the pole piece 62 has a smaller diameter than the aperture 66 at the upper end face 61 of the pole piece 62.

The pole piece 62 is also provided with a through drilling 72 in the thick walled region 70 of the pole piece 62 and which forms part of a fuel supply passage when the actuator arrangement 60 is assembled as part of a fuel injector, in use.

Figure 3:
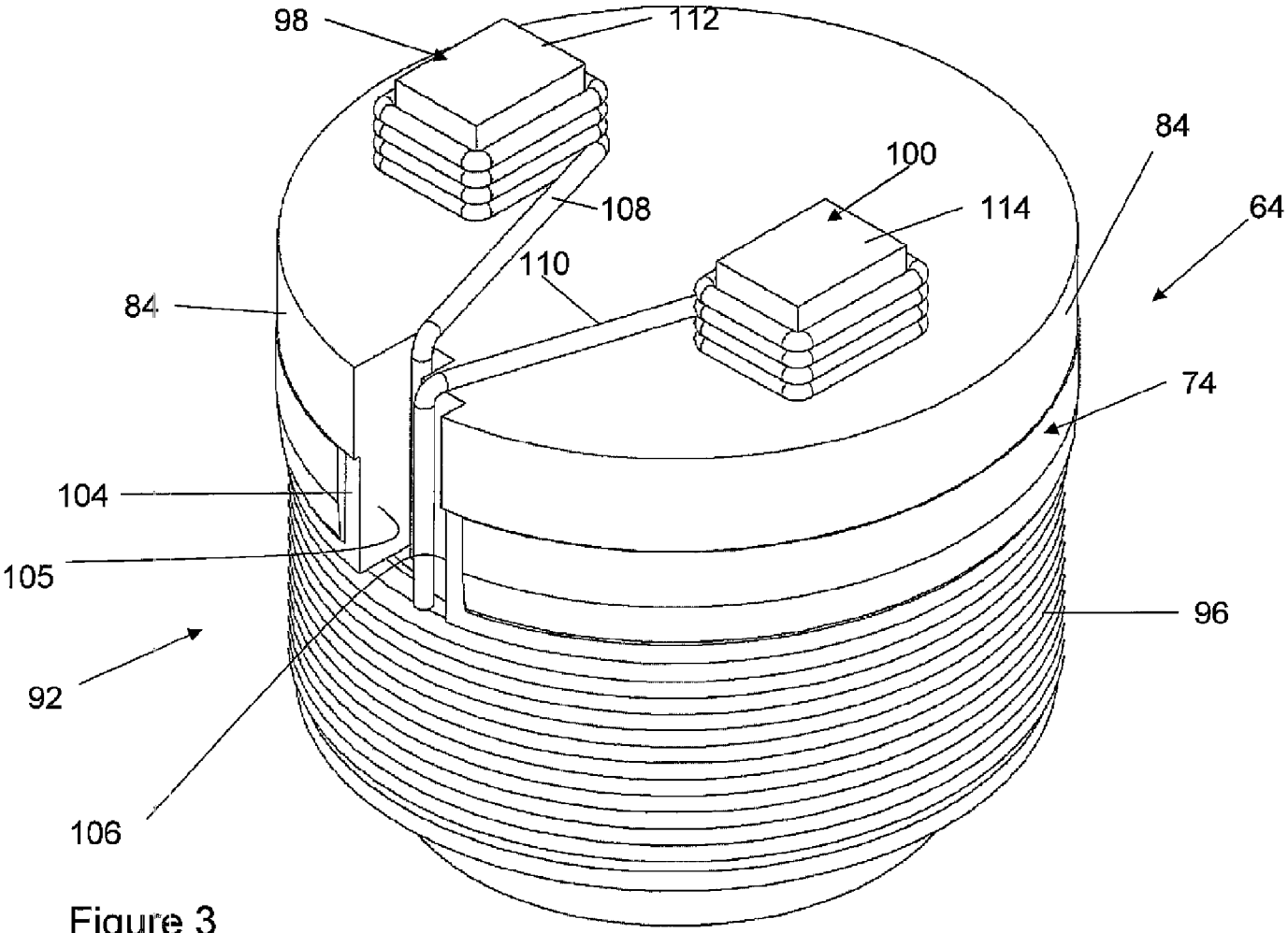
FIG. 3 is a perspective view of the actuator arrangement of FIG. 2, but with the pole piece removed.
Figure 4:
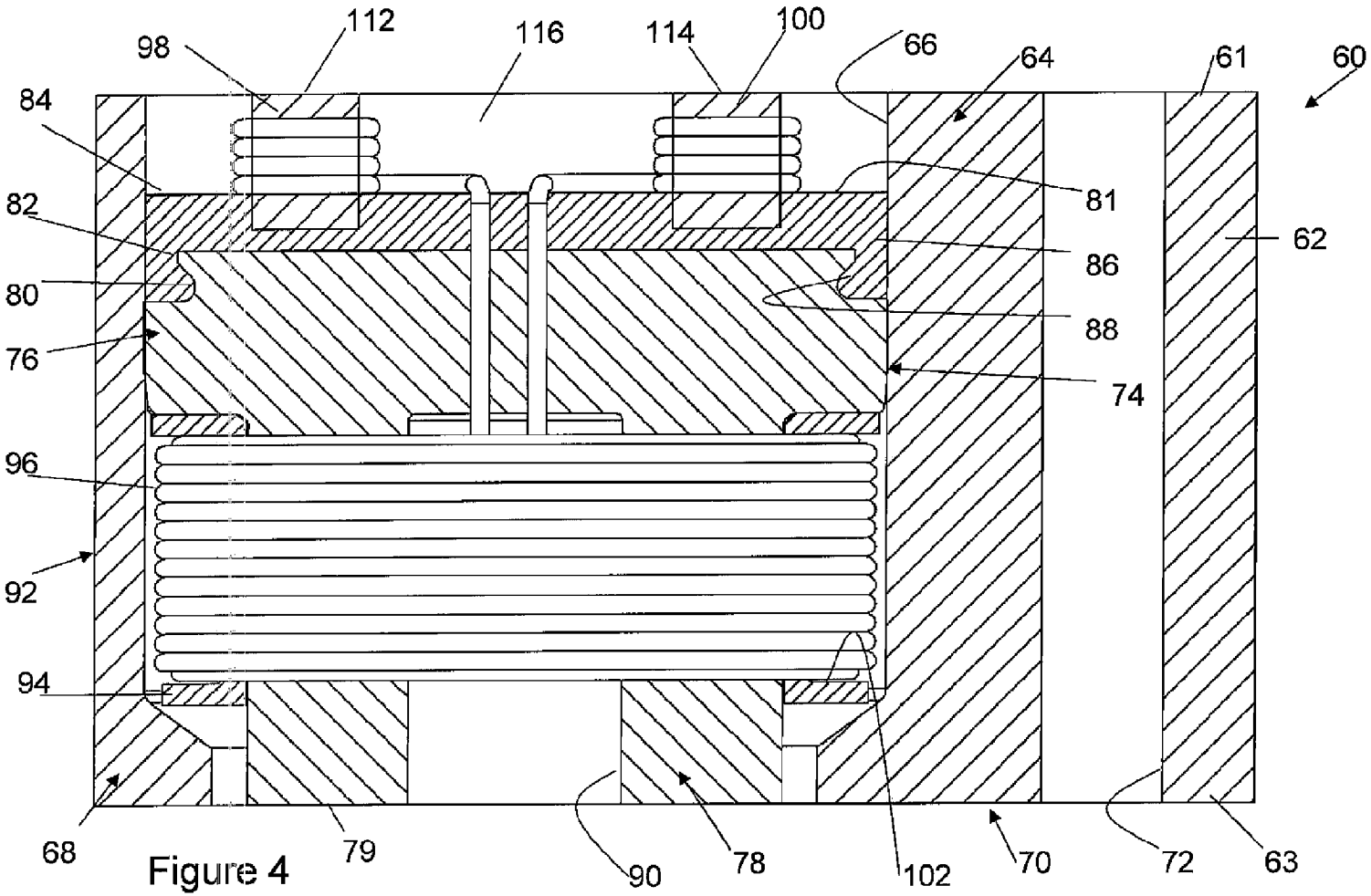
FIG. 4 is a section view of the actuator arrangement of FIG. 2.

The actuator core 64 is shown more clearly in FIGS. 3 and 4 and includes a metallic annular core member 74 that is generally T-shaped in cross-section so as to define an enlarged upper region 76 having an upper face 81, and a lower region 78 of smaller diameter which depends down from the upper region 76 in the orientation in FIGS. 3 and 4. The core member 74 has a circular outer profile that is complementary with the circular aperture 66 of the pole piece 62 such that the core member 74 may be assembled in any number of angular positions with respect to the pole piece 62. In the embodiment shown, the core member defines an interference fit with the aperture of the pole piece such that the core member is held secure when installed within the aperture. Alternatively, the core member and the aperture may define a clearance fit or a running fit such that rotation is possible between the two components. The core member is then secureable in position by other methods such as welding or gluing during production such that no movement can occur in use.

The upper region 76 of the core member 74 includes an annular groove 80 around the edge of the upper face 81 that provides the upper region 76 with an annular rim 82 which projects from the groove 80 but has a rim diameter slightly less than that of the upper region 76.

In order to help environmentally insulate, seal and secure the core member 74, the upper face 81 carries a polymeric insulator member 84 in the form of a disc. The insulator disc 84 is injection moulded onto the core member 74 such that the outer diameter of the insulator disc 84 is substantially the same as the outer diameter of the upper region 76 of the core member 74. Since the insulator disc 84 is moulded to conform to the shape of the upper face 81 of the core member 74, the disc 84 is provided with a skirt 86 which depends downward from its outer edge and also defines a small inwardly extending lip 88 that conforms to the shape of the annular rim 82. The insulator disc 84 thus mates with the upper region 76 of the core member 74 and is secured thereto by engagement between the rim 82 and the lip 88.

The lower region 78 of the core member 74 includes a centrally disposed blind bore 90 which extends upwardly (in the orientation shown in the drawings) and terminates approximately in line with the transition between the upper and lower regions 76, 78 of the core member 74. Although not shown in the Figures, it should be appreciated that, in use, the blind bore 90 receives a return spring associated with an armature which is operable by the actuator arrangement 60. The presence of the blind bore 90 provides the lower region 78 with a ring like end face 79.

The actuator core 64 also includes an electrical winding arrangement, indicated generally as 92, that is carried on the lower region 78 of the core member 74. The electrical winding arrangement 92 includes a coil former 94, a solenoid 96 that is formed on the coil former 94, and first and second contact members 98, 100 that are carried by and integrated with the insulator disc 84, above the upper face 81 of the core member 84.

The coil former 94, also referred to as a 'bobbin', is an annular member that is preferably made from a polymeric material, for example a thermo-plastic or thermoset polymer, and is approximately C-shaped in cross-section to define a radially outward facing channel 102 for receiving the solenoid 96 and an inner wall having a diameter comparable with the diameter of the lower region 78 of the core member 74. It should be appreciated that the precise number of coils in the solenoid 96 is predetermined in order to provide the actuator arrangement 60 with suitable operating characteristics. However, the number of coils is not central to the present invention and will not be discussed in detail here.

The insulator disc 84 and the coil former 94 are connected to one another by a link member 104 that extends through a slot 106 provided in the core member 74. Thus, the insulator disc 84, coil former 94 and link member 104 are formed as an integrated unitary polymeric component by an injection moulding process.

The link member 104 provides a channel 105 for first and second terminal ends 108, 110 of the solenoid 96 to extend up onto the upper face of the insulator disc 84 without extending beyond the outer circular profile of the insulator member. Each one of the first and second terminal ends 108, 110 are wound around a respective one of the first and second contact members 98, 100 four times which achieves a strong attachment, although one or more turns of wire is also acceptable to achieve a good fixing.

Each of the first and second contact members 98, 100 are right cuboids which define respective flat upper faces 112, 114 that are substantially flush (i.e. coplanar) with the upper face 61 of the pole piece 62. Since the first and second terminal ends 108, 110 of the solenoid 96 are wound around their respective contact members 98, 100, the relatively sharp edges of the contact members grip the terminal ends to ensure that they remain securely attached. This configuration provides each contact member with a simple construction and should be compared with previous techniques in which the contact member included a portion that connected to terminal ends of the solenoid which is remote from the contact face.

Figure 5:
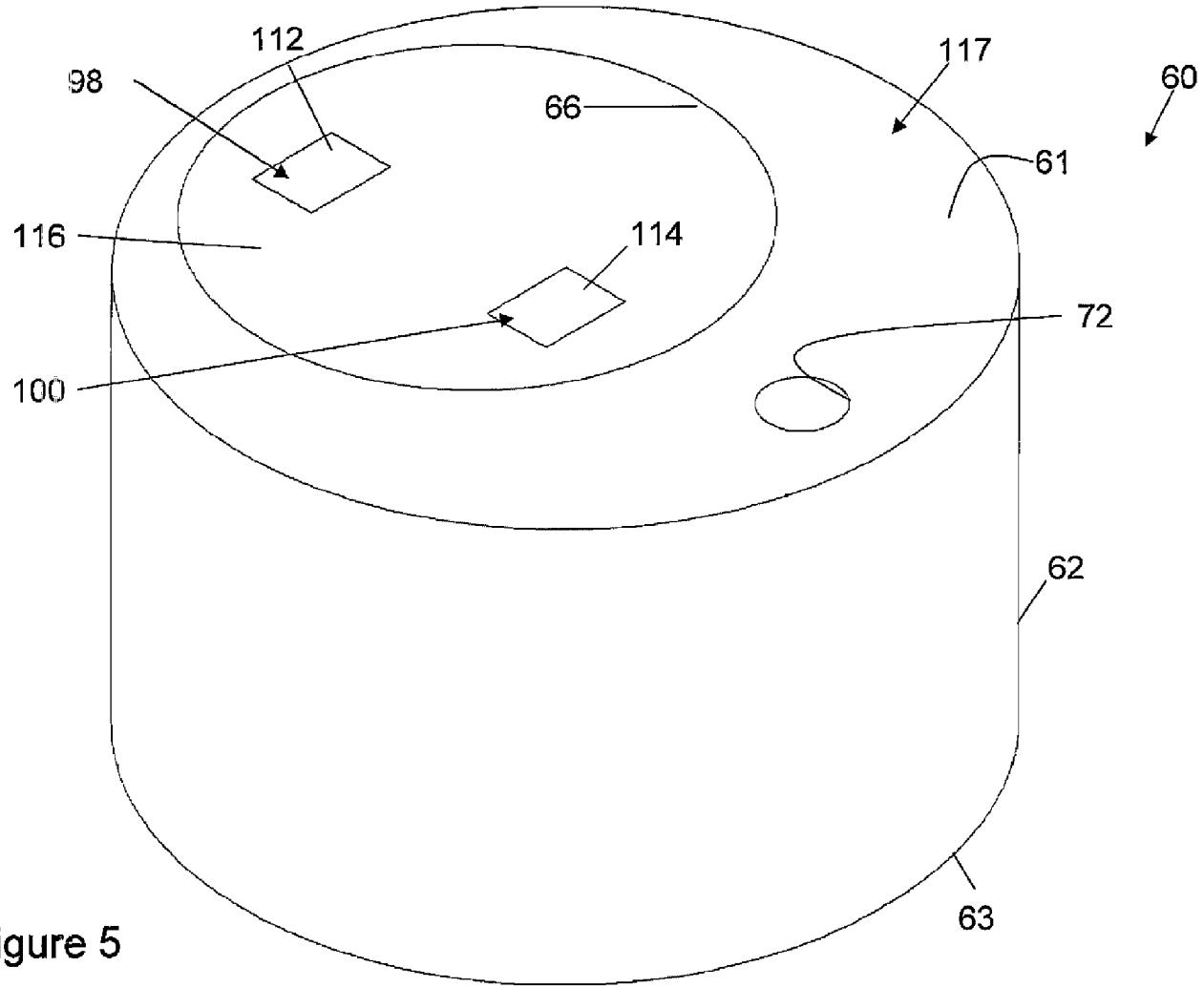
FIG. 5 is a perspective view of the actuator arrangement in FIG. 4.

As shown in FIGS. 4 and 5, the actuator arrangement 60 also includes an encapsulating member 116 (hereafter also referred to as 'encapsulant') formed of a layer of polymeric material that fills the space between the insulator disc 84 up until the level of the upper face 61 of the pole piece 62, such that only the contact faces 112, 114 of the contact members are exposed. The encapsulant 116 also permeates into the space between the pole piece 62 and the solenoid 96. This later encapsulation moulding may also use a thermo-plastic or thermoset polymer, but which is preferably applied using less injection pressure and/or temperature than as for the coil former and insulator disc to avoid damaging the former and disc. The encapsulant thus supports, protects and insulates the terminal ends of the solenoid whilst exposing only the contact faces of the contact members for connection to an electrical supply arrangement, in use.

The encapsulant 116 sits in the upper end of the aperture 66 and defines an upper face 117 that is flush with the upper faces 112, 114 of the contact members 98, 100 and also the upper end face 61 of the pole piece.

It will be appreciated that the flushness of the upper faces of the contact members 98. 100, the encapsulant 116 and the pole piece 62 provides the actuator with a substantially planar surface 117 which can be mated to an adjacent component within the fuel injector, in use. Such a planar surface presents a two-dimensional, smooth and flat upper face that is substantially free from surface irregularities such as grooves, channels, slots or crevices which is beneficial since it guards against the trapping of particles during manufacturing. The presence of debris at the contact faces, for example, is unacceptable and would require attention before the actuator arrangement can be installed.

The actuator arrangement 60 includes beneficial features that enables the position of the contact members 98, 100 to be optimised for installation within different designs of injectors.

Firstly, it should be noted that the first and second contact members 98, 100 are received within the insulator disc 84. Although the contact members may be installed in preformed recesses defined in the insulator disc 84, preferably they are pressed against the disc 84 whilst applying a suitable technique to melt, or at least soften, the polymeric material of the insulator disc 84 in the region around the contact members. Suitably, an ultrasonic welding technique may be used. However, it should be appreciated that local heating techniques would also be appropriate. In this way, the additional manufacturing step of forming recesses in the insulator disc, or moulding such a disc with a complicated shape, can be avoided.

Furthermore, installing the contact members 98, 100 into the insulator disc 84 using ultrasonic welding enables a flexible approach to the positioning of the contact members. Thus, the position of the contact members can be changed depending on the contact position that may be required by the internal electrical connections of the injector within which the actuator arrangement is to be used.

A further beneficial feature is that the aperture 66 provided in the pole piece 62 and lateral outer profile of the core member 74 are shaped so as to allow the core member 74 to be orientated at any angular position relative to the pole piece 62. This enables the contact members 98, 100 to be rotated within the pole piece 62 to suit the requirements of the internal electrical connections of the associated injector. In the embodiment described, the aperture 66 is circular to mate or to complement the circular profile of the core member 74. However, it should be appreciated that this specific shape is exemplary only and the core member and/or the aperture could also take other forms, which would be apparent to the skilled person, whilst still permitting relative angular movement between the two components.

Figure 2:
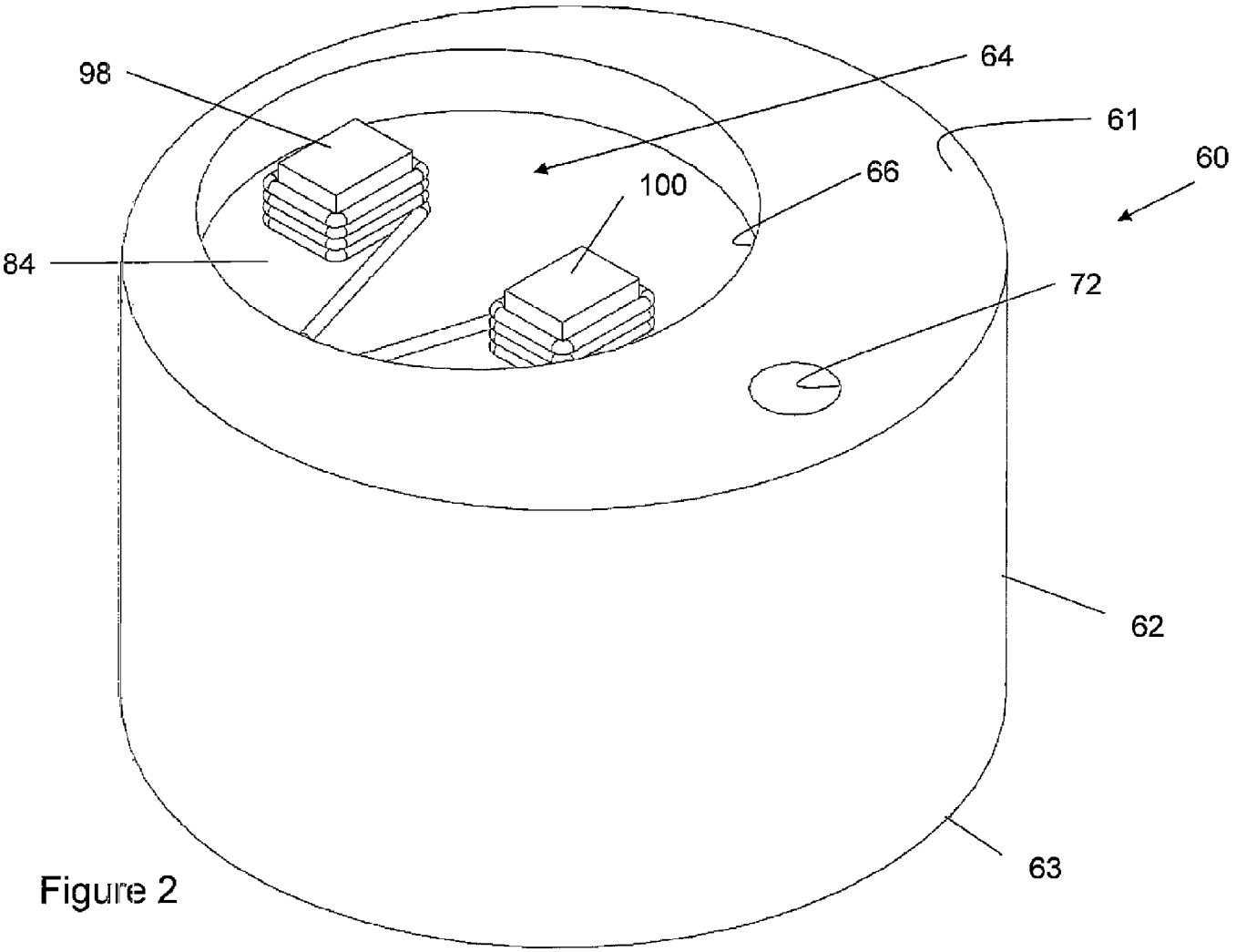
FIG. 2 is a perspective view of an actuator arrangement in accordance with the invention.

A method of constructing the actuator arrangement of FIGS. 2 to 4 will now be described.

In a first step, the coil former 94, the link member 104 and the insulator disc 84 are injection moulded onto the core member 74 in situ. The contact members 98, 100 are then installed on the insulator disc 84 preferably by ultrasonic welding as has been described above.

Following this, the solenoid 96 is built up on the coil former 94 to a predetermined number of turns. In order to connect the solenoid 96 to the contact members 98, 100, the terminal ends 108, 110 are routed up through the channel 105 defined by the link member 104 and wound around the contact members 98, 100 as described above.

The assembled actuator core 64 is then inserted into the aperture 66 of the pole piece 62 and positioned such that the first and second contact faces 112, 114 of the contact members 98, 100 lie in a plane substantially common to the planar upper face 61 of the pole piece 62. Also, when in this position, the end face 79 of the lower region 78 of the core member 74 is substantially coplanar with the underside surface 63 of the pole piece 62.

The encapsulant member 116 is then introduced into the space intermediate the pole piece 62 and the solenoid 96 and the space around the contact members 98,100 up to at least level with the upper face 61.

To finish the actuator arrangement 60, the upper and lower faces 61, 63 of the pole piece 62, together with the contact faces 112, 114 of the contact members 98, 100 are machined substantially simultaneously in order to provide a smooth finish. It is preferred that the upper and lower faces 61, 63 are machined using a grinding technique, although it should be appreciated that other techniques are also applicable, such lapping, abrasive honing or milling. Since the contact faces of the contact members are coplanar with the upper face 61 of the pole piece, and the lower end face 79 of the core member 74 is coplanar with the underside 63 of the pole piece, these faces are also machined substantially simultaneously.

Machining the upper and lower faces substantially simultaneously, also referred to as 'duplex grinding', promotes parallelism between the upper and lower faces of the actuator arrangement which improves the ability of the actuator arrangement to mate with adjacent components. Furthermore, duplex grinding reduces part-to-part variation which promotes consistent magnetic performance between multiple actuator arrangements. In addition, grinding the upper and lower faces of the actuator arrangement in this way requires only a single manufacturing step compared with grinding one face at a time.

In the alternative, only the upper face 61 of the pole piece together with the contact faces 112, 114 may be machined simultaneously, and the lower face 63 of the pole piece 62 is machined in a different operation. This embodiment is still advantageous in that a good geometric match is established between the upper face 61 and the contact faces 112, 114, as well as the encapsulant member 116. Also, machining in this way creates a smooth or 'clean' surface with no grooves, slots, pits or non-flush regions that may otherwise acts as debris traps.

The skilled person will appreciate that the above embodiments are described as exemplary only and that modifications may be made without departing from the inventive concept as defined by the claims.

Although the first and second contact members 98, 100 are described above as cuboid in form, it should be appreciated that other shapes are possible without affecting function. For example, the contact members 98, 100 may also be one of the set of uniform polyhedra, such that the terminal ends 108, 110 of the solenoid 96 are able to be wound around the contact members for a plurality of turns thereby attaching the terminal ends to the contact members securely. It should be appreciated that other forms of geometric prisms, for example regular polygonal prisms, may also be applicable and the overall objective is to secure the terminal ends of the solenoid to their respective contact members directly without the need for further contacting parts.

The invention claimed is:

1. An actuator arrangement for an electromagnetically operated fuel injector, comprising:

a pole member having a first end face and defining an aperture extending from the first end face;

an actuator core received within the aperture, wherein the actuator core carries at least one contact member having a contact face that is exposed through the aperture, wherein an encapsulating member is received within the aperture and surrounding the at least one contact member, and wherein the first end face of the pole member, the contact face and the encapsulating member are arranged to provide the actuator arrangement with a planar surface for mating with an adjacent component.

2. An actuator arrangement as claimed in claim 1, wherein the aperture is offset from the longitudinal axis of the pole member so as to provide the pole member with a major wall portion and a minor wall portion and wherein the major wall portion defines an axial drilling.

3. An actuator arrangement as claimed in claim 2, wherein the axial drilling is parallel to the longitudinal axis of the actuator.

4. An actuator arrangement as claimed in claim 1, wherein the at least one contact member comprises first and second contact members that are exposed through the aperture and the actuator core comprises a core member, wherein the aperture of the pole member, and the core member, are shaped to permit the core member to be angularly orientated within the aperture relative to the pole member.

5. An actuator arrangement as claimed in claim 4, wherein the aperture is circular and the core member is circular.

6. An actuator arrangement as claimed in claim 4, wherein the first and second contact members are integrated within an insulator member that is carried on the core member.

7. An actuator arrangement as claimed in claim 6, wherein an encapsulating layer is carried on the insulator member and envelops the first and second contact members such that contact faces defined by the contact members are flush with a first surface of the encapsulating layer.

8. An actuator arrangement as claimed in claim 6, wherein the first and second contact faces defined by the first and second contact members are flush with a first surface of the pole member.

9. An actuator arrangement as claimed in claim 1, wherein:

the actuator core comprises a solenoid having first and second terminal ends and a core member;

and the actuator arrangement further comprises an insulator member carried on the core member; and first and second contact members received within the insulating member, wherein the at least one contact member is the first contact member, wherein the first terminal end of the solenoid is secured to the first contact member and wherein the second terminal end of the solenoid is secured to the second contact member.

10. An actuator arrangement as claimed in claim 9, wherein the first terminal end is wound around the first contact member for one or more turns and wherein the second terminal end is wound around the second contact member for one or more turns.

11. An actuator arrangement as claimed in claim 10, wherein each of the first and second contact members is provided with edges that grip the respective terminal end.

12. An actuator arrangement as claimed in claim 9, wherein each of the first and second contact members defines a respective contact face which engages respective power supply electrodes of opposite polarity, in use.

13. An actuator arrangement as claimed in claim 9, wherein each of the first and second contact members is a polyhedron.

14. An actuator arrangement as claimed in claim 9, wherein the first and second contact members are received in the insulating member by initially melting the insulating member in regions local to the first and second contact members and urging the first and second contact members into the melted regions of the insulating member.

15. An actuator arrangement as claimed claim 9, wherein the solenoid is wound on a coil former carried by the core member and wherein the coil former and the insulating member are linked by a linking member that extends through a slot provided on the core member, such that the insulating member and the coil former are a unitary component.

16. A method of constructing an electromagnetic actuator for a fuel injector, comprising:

providing an actuator core member, moulding an insulating member onto a first end face of the core member;

providing at least one contact member, and integrating the at least one contact member with the insulating member by locally melting the insulating member in the region of the at least one contact member to soften said insulating member and urging said at least one contact member into the insulating member.

17. The method of claim 16, including locally melting the insulating member by ultrasonic welding.

18. The method of claim 16, further including moulding a coil former onto the core member and forming a solenoid onto the core member.

19. The method of claim 18, wherein the insulating member and coil former are a unitary moulded component.

20. A method for constructing an electromagnetic actuator for a fuel injector, comprising:

providing a pole member having first and second faces and defining an aperture;

receiving an actuator core member within the aperture, the core member having at least one contact member associated therewith exposed through the aperture and coplanar with the first end face of the outer pole member;

machining the first end face of the pole member and the at least one contact member simultaneously.

* * * * *